United States Patent [19]

Ashizawa et al.

[11] Patent Number: 4,795,065

[45] Date of Patent: Jan. 3, 1989

[54] SPOUT FOR PACKAGING CONTAINERS

[75] Inventors: Kenji Ashizawa; Hiroshi Uematsu, both of Tokyo, Japan

[73] Assignee: Dai Nippon Insatsu Kabushiki Kaisha, Tokyo, Japan

[21] Appl. No.: 21,010

[22] PCT Filed: May 27, 1986

[86] PCT No.: PCT/JP86/00267

§ 371 Date: Jan. 27, 1987

§ 102(e) Date: Jan. 27, 1987

[87] PCT Pub. No.: WO86/07032

PCT Pub. Date: Dec. 4, 1986

[30] Foreign Application Priority Data

May 27, 1985 [JP] Japan ..... 60-78987

[51] Int. Cl.[4] ..... B65D 17/32; B65D 43/24

[52] U.S. Cl. ..... 222/541; 222/556; 220/269; 220/335

[58] Field of Search ..... 222/541, 517, 556; 220/335, 269, 270, 266; 215/235, 236, 253

[56] References Cited

U.S. PATENT DOCUMENTS

| | | | |
|---|---|---|---|
| 586,492 | 7/1987 | Hauman | 220/335 |
| 677,466 | 7/1901 | Ortner | 220/335 X |
| 2,196,530 | 4/1940 | Johnson et al. | 220/335 X |
| 3,966,080 | 6/1976 | Bittel | 220/269 |
| 4,103,804 | 8/1978 | Fournier et al. | 220/335 X |
| 4,265,367 | 5/1987 | Vogt | 220/335 X |
| 4,669,640 | 6/1987 | Ando et al. | 220/335 X |

*Primary Examiner*—Joseph J. Rolla
*Assistant Examiner*—Nils E. Pedersen
*Attorney, Agent, or Firm*—Parkhurst, Oliff & Berridge

[57] ABSTRACT

A spout (1, 1A) attached to a paper container (C) into which is filled a beverage such as milk, juice or the like is made of an elastic material such as polyethylene resin in such a way that it comprises a main body (3) in the form of a pipe or a case passed through the wall of the container and a cover (2) for closing an opening of the main body (3), the main body and the cover being made as an integral body. The cover (2) and the main body (3) are interconnected with each other through a reduced-thickness separable portion (9) which is severed when the cover (2) is opened and through a reduced-thickness portion (7) which functions as a hinge portion when the cover (2) is opened. The main body (3) and the cover (2) have formed on the outer surfaces thereof a first engagement element (10, 10D) and a second engagement element (11, 11D). When a tab (12) is pulled upwardly to open the cover (2), the distal end of the second engagement element (11, 11D) engages with the first engagement element (10, 10D) so that the cover (2) is maintained in an opened position. When the cover (2) is closed, an engaging projection (**8*a*) is brought into engagement with the inner surface of the main body (3), whereby the cover (2) is maintained in the closed position. One of a pair of engagement elements can be replaced by an engaging recess (10E, 11F, 11G**).

9 Claims, 3 Drawing Sheets

SPOUT FOR PACKAGING CONTAINERS

TECHNICAL FIELD

The present invention relates to a spout for packaging containers in which milk, juice and other beverages are filled in hermetically sealed state. The spout in accordance with the present invention is applied advantageously to, for instance, gable-to-sealed type paper containers, rectangular-box-shaped paper containers or the like.

BACKGROUND ART

Heretofore, in order to dispense the content in packaging containers containing milk, juice or the like, an opening is formed by cutting off or pulling out the sealed portion of the containers. For this purpose, scissors are needed or a considerably great opening force is required. Further, the fingers of the person opening the container contact with the opening so that the latter cannot be maintained in sanitary condition. Furthermore, in the case of providing an opening forming means in the form of a spout having a sealing cap thereon, the spout main body and the sealing cap must be separately fabricated so that the fabrication steps are increased in number and the fabrication costs become expensive.

The object of the present invention is to provide a spout for a packaging container which makes it unnecessary to cut off or pull out the sealed portion of the container or to remove a sealing cap for the purpose of dispensing the content of the container, which makes it easy and simple to open the container for dispensing the content and to reclose the same, which can be kept sanitary and be produced easily and which can be operated easily.

DISCLOSURE OF THE INVENTION

A spout in accordance with the present invention comprises a main body which has means for attaching the main body to a packaging container and which has an opening, and a cover which is formed integral with the main body to close the opening. The cover has one side integrally joined to the main body through a reduced-thickness portion which forms a hinge portion, and the remaining portion except said hinge portion is integrally joined to the main body through a reduced-thickness separable portion. A first engaging means formed integral with the outer surface of the main body is provided outside of the hinge portion but adjacent thereto. A second engaging means is formed integral with the outer surface of the cover at a position inside the hinge portion. The second engaging means is so designed, constructed and positioned that when the cover is swung in the opening direction about the hinge portion after the reduced-thickness separable portion is severed, it will engage the first engaging means so as to maintain the cover in the opened state. The first and second engaging means are made of the same elastic material.

The spout in accordance with the present invention can be attached to any suitable packaging containers. When a liquid filled into a packaging container is to be dispensed, the reduced-thickness separable portion between the cover and the main body is severed and the cover is swung in the opening direction about the hinge portion so that the cover can be maintained in the opened state by the mutual engagement of the first and second engaging means which are disposed on the main body and the cover, respectively and are spaced apart from each other with the hinge portion therebetween, whereby the liquid content can be discharged. When it is desired to stop the discharge, the cover is fitted with the main body, thereby closing the spout.

BEST MODES FOR CARRYING OUT THE INVENTION

Figure 1:
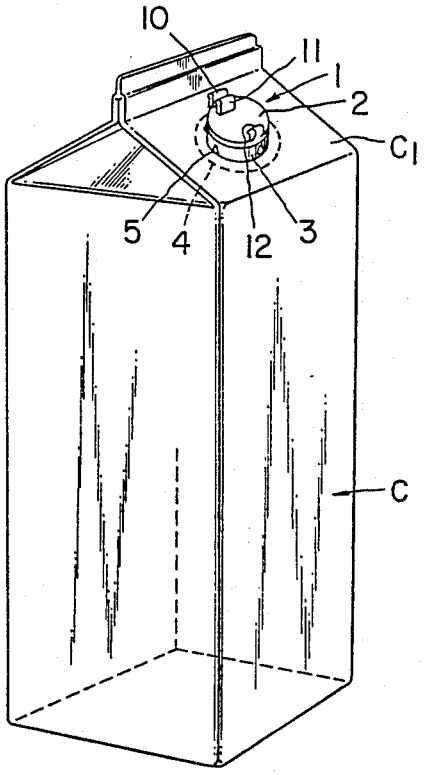
FIG. 1 is a perspective view of a packaging container to which is applied a spout in accordance with the present invention.

As shown in FIG. 1, a spout 1 in accordance with the present invention is attached to a packaging container C for any liquid which is shown as a gable-top-sealed paper container for containing a beverage such as milk, juice or the like. The spout 1 is attached to an inclined top wall $C_1$. The container may be a rectangular-box-shaped paper container or any other container having various configurations.

Figure 2:
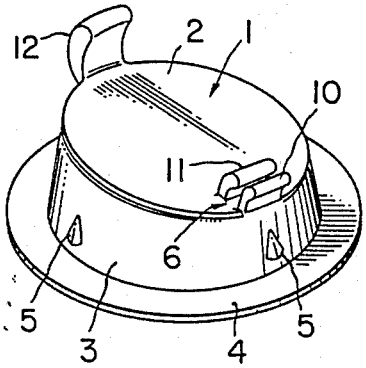
FIG. 2 is a perspective view of a spout in accordance with the present invention.

The spout 1 may be formed as an integral unit by injection molding process from an elastic synthetic resin such as polyethylene resin or the like. As shown in FIG. 2, it generally comprises a lower cylindrical main body 3 and an upper cover 2. A peripheral flange 4 is formed integral with the base portion of the cylindrical main body 3 and, as shown in FIG. 1, the peripheral flange 4 is made into contact with the inner surface of the inclined top wall $C_1$ of the container C. The cylindrical main body 3 is passed outwardly through a hole formed through the top wall $C_1$ of the container, whereby the spout 1 is joined to the container C. As shown in FIG. 2, projection 5 for a purpose of preliminarily retaining the spout in the hole of the top wall are provided on the outer surface of the main body 3 at positions spaced apart from the peripheral flange 4, and the peripheral portion of the hole of the wall $C_1$ of the container C is inserted between the peripheral flange 4 and the projections 5.

Figure 3:
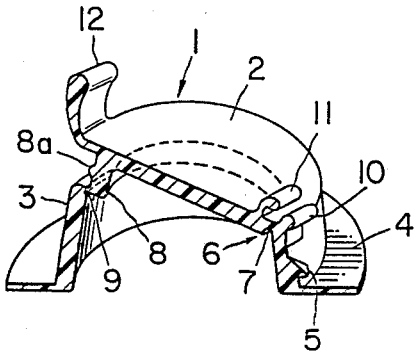
FIG. 3 is a longitudinal sectional perspective view thereof.

As shown in FIG. 3, the cover 2 is inclined in such a manner that its left end as viewed in this figure is higher while its right end is lower. The lower end of the cover 2 is integrally connected through a straight reduced-thickness portion 7 to the upper portion of the cylindrical main body 3. The reduced-thickness portion 7 defines a hinge portion 6 for the cover 2.

Meanwhile, a cylindrical wall 8 is formed integral with the rear surface of the cover 2 except at its hinge portion 6. The cylindrical wall 8 is highest at its left end whereby the cover 2 is inclined as described above. The lower end of the cylindrical wall 8 is integrally joined through a reduced-thickness separable portion 9 to the cylindrical main body 3. The reduced-thickness separable portion 9 is formed arcuately along the upper end of the cylindrical main body 3 and its both ends are terminated at positioned adjacent to the straight reduced-thickness portion 7 and are spaced apart therefrom by a small distance. An engaging projection **8*a* is formed on the highest portion of the cylindrical wall 8. The cylindrical wall 8 is so designed and constructed that it may be fitted into the cylindrical main body 3 with the outer surface of the cylindrical wall in contact with the inner surface of the cylindrical main body 3**.

A first and a second straight engagement elements 10 and 11 are formed integral with the cylindrical main body 3 and the cover 1, respectively, in parallel with the hinge portion 6 and are spaced apart with the hinge portion 6 therebetween. It is to be understood that the engaging elements 10 and 11 are not necessarily straight. The engaging element 10 is extended outwardly and obliquely upwardly, and the engagement elements 10 and 11 have distal end portions each in the form of a hook. An opening and closing tab 12 is formed integral with the cover 2 in diametrically opposed relationship with the engaging elements 10 and 11. When the tab 12 is joined flexibly to the cover 2 (for instance, by slightly reducing the thickness of the interconnecting portion between the tab 12 and the cover 2), the tab 12 will bend when a force is unintentionally exerted thereto so that no severing force will be transmitted to the reduced-thickness portion, whereby the opening of the cover 2 by mischievous handlings can be prevented.

The spout of the present invention is constructed in the manner described above. Therefore, when the tab 12 is pulled upwardly, the cover 2 will be sheared off from the cylindrical spout main body 3 along the reduced-thickness portion 9 to the positions adjacent to the hinge portion 6 and be swung upwardly about the hinge portion 6 which is defined by the straight reduced-thickness portion 7, whereby the spout is opened. In order to prevent the reduced-thickness portion 7 from being severed when the reduced-thickness portion 9 is being severed, the reduced-thickness portion 9 is not joined to the reduced-thickness portion 7.

Figure 4:
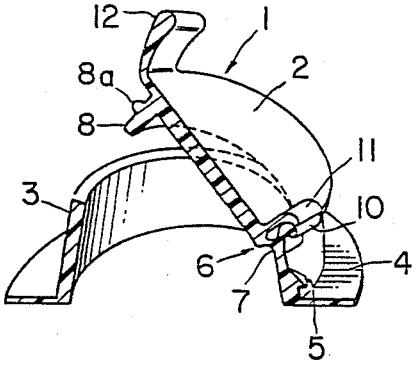
FIG. 4 is a longitudinal sectional perspective view illustrating the cover of the spout in an opened state.

As the cover 2 is swung upwardly, the distal end of the engaging element 11 of the cover is brought into engagement with the distal end of the engaging element 10 of the cylindrical main body 3 as shown in FIG. 4 whereby the cover 2 is maintained in the opened position. Therefore, the content can be easily dispensed.

Figure 5:
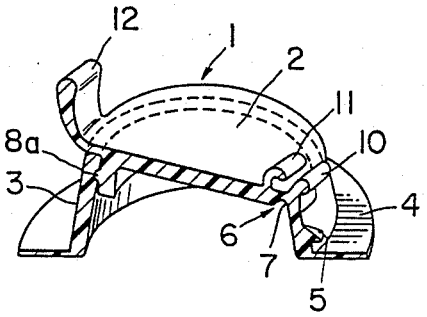
FIG. 5 is a longitudinal sectional perspective view of the spout with the cover in closed state after the cover has been opened.

After the discharge of the content from the container, the cover 2 is pushed down whereby the cylindrical wall 8 of the cover is fitted into and engaged with the cylindrical main body 3 as shown in FIG. 5 and the cover is maintained in the closed position. This condition can be attained by pressure contact of the engaging projection **8*a* with the inner wall of the cylindrical main body 3**.

Figure 6:
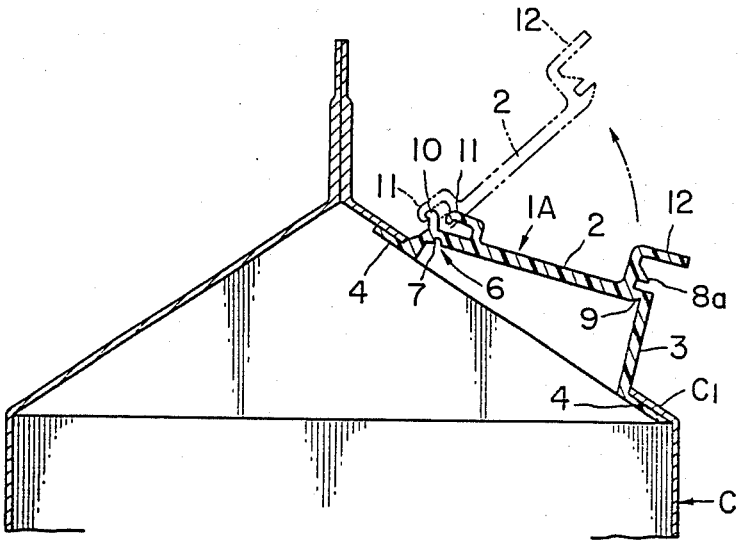
FIG. 6 is a longitudinal sectional view of an upper portion of a packaging container to which is applied another embodiment of the spout in accordance with the present invention.
Figure 7:
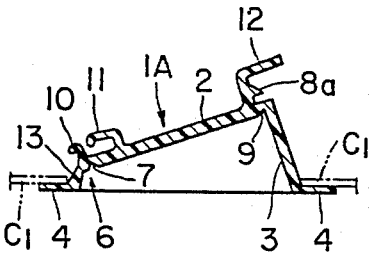
FIG. 7 is a longitudinal sectional view of the spout shown in FIG. 6.
Figure 8:
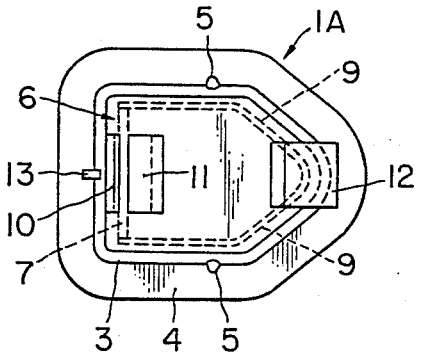
FIG. 8 is a top view thereof.
Figure 9:
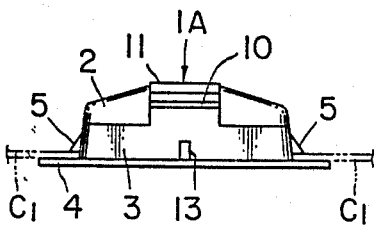
FIG. 9 is a left side view thereof.
Figure 10:
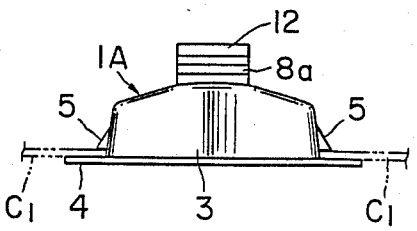
FIG. 10 is a right side view thereof.

Referring next to FIGS. 6 through 10, another embodiment of the present invention will be described. Differences between a spout 1A shown and the above-described embodiment are as follows. Unlike the above-described embodiment, the rear surface of the cover 2 is not formed with the cylindrical wall 8 and the cover 2 is directly and integrally joined to the upper end of the cylindrical main body 3 through a reduced-thickness portion 7 which functions as the hinge portion 6 and a reduced-thickness separable portion 9. The main body 3 is not in the form of a cylinder but has a pentagonal cross-sectional configuration. It is so designed and constructed that the right side as viewed in FIGS. 6 through 8 is higher while the left side is lower. Furthermore, the reduced-thickness separable portion 9 is made thinner than the reduced-thickness portion 7 which serves as the hinge portion so that it becomes easier to sever the separable portion 9.

The tab 12 is disposed at one side of the cover 2 and an engaging projection **8*a* is formed on its upright portion. The second engaging element 11 disposed on one side of the hinge portion 6 is curved toward the first engaging element 10 disposed on the other side, and when the cover 2 is opened, the distal end of the second engagement element 11 approaches and then engages the first engaging element 10 as indicated by the phantom lines in FIG. 6 whereby the cover 2** is maintained in the opened state.

A fin 13 which is provided in this embodiment is so formed as to have an inclined side extended from a position adjacent to the lower portion of the main body 3 toward the peripheral flange 4 and, as shown in FIG. 7, the inclined side is made in contact with the periphery of the hole of the top wall $C_1$ of the container so that it has a function of pressing the opposite edge portion of the hole against the main body 3.

Same reference numerals are used to designate similar parts in FIGS. 1 through 5 and the repetition of the description of the similar parts will not be made.

Figure 11:
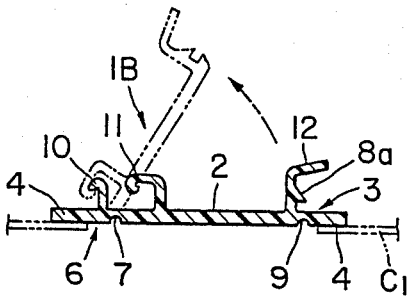
FIGS. 11 and 12 are longitudinal views illustrating two different modified embodiments, respectively, of the present invention.

In the case of the above-described embodiments, the main body 3 is in the form of a pipe or case, but it is not necessarily so formed. FIG. 11 illustrates a spout without any part in the form of a pipe or case. Here, part of the peripheral flange 4 serves as a main body which in turn is directly joined to the remainder of the peripheral flange 4.

Figure 12:
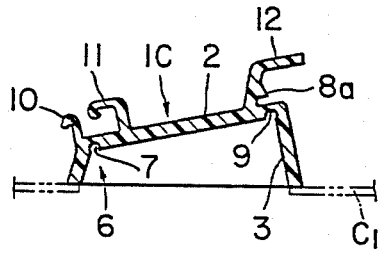

The peripheral flange 4 itself can be eliminated as shown in FIG. 12. In the embodiment shown therein, the base end surface of the main body 3 in the form of a tube or case is directly joined to the top wall portion $C_1$ of the container.

Figure 13:
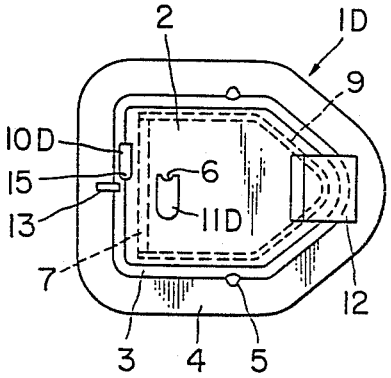
FIGS. 13 and 14 are a top and a side view, respectively, of a further modified embodiment of the present invention.
Figure 14:
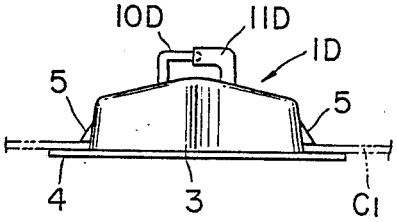

The first and second engagement elements 10 and 11 need not be in completely opposed relationship with each other. As shown in FIGS. 13 and 14, a first engaging element 10D and a second engaging element 11D are offset from each other and only when the cover 2 is opened, a projection 15 on one end of the first engaging element 10D is fitted into a recess 16 formed at one end of the second engaging element 11D.

Figure 15:
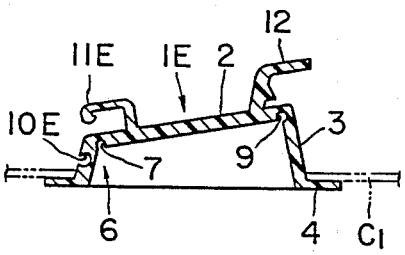
FIGS. 15, 16 and 17 are longitudinal sectional views of still further three different modified embodiments, respectively, of the present invention.

In an embodiment shown in FIG. 15, instead of the first engaging element, a first engagement recess 10E is formed to receive therein the distal end of the second engaging member 11E when the cover 2 is opened.

Figure 16:
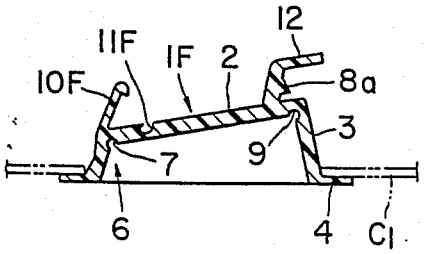
Figure 17:
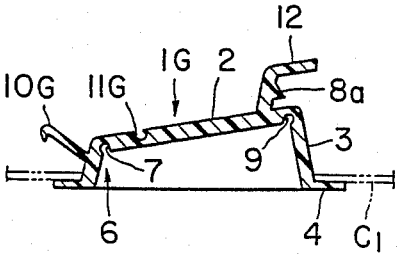

In an embodiment shown in FIG. 16, the cover 2 is formed with a second engaging recess 11F for engagement with a first engaging element 10F. In an embodiment shown in FIG. 17, a first engaging element 10G which is adapted to engage a second engaging recess 11G is extended away from the second engaging recess 11G whereby the cover 2 can be maintained in the widely opened state.

As described above, in the spouts according to the present invention, when the cover is pulled by utilizing the tab, the reduced-thickness portion interconnecting the cover and the main body is severed so that an open spout can be easily formed. Furthermore, the cover can be maintained in the opened state by the engagement between the engaging elements whereby the dispensing of a liquid from the packaging container is much facilitated. Moreover, in case of opening the spout, fingers do not make contact with the spout itself and a portion therearound so that sanitary condition can be maintained. In addition, when the spout is closed, the cover is pushed down to engage with the main body, whereby the firmly closed state can be maintained.

Furthermore, the spouts for packaging containers in accordance with the present invention are simple in construction so that they can be produced by plastic injection molding process as an integral unit at less costs.

INDUSTRIAL APPLICABILITY

The spouts in accordance with the present invention can be applied to paper packaging containers in which is filled a beverage in hermetically sealed state, as well as to other containers.

We claim:

1. A sealed gable top carton for containing liquid product, comprising:

a box-shaped body having a closed bottom;

a gable top closing a top end of the box-shaped body and having a pair of oppositely inclined top walls, one of which has a hole therethrough;

a spout attached to said one top wall and having a main body which is sealingly passed through said hole and has an opening, said spout having a cover integrally joined to said main body so as to close said opening of the main body, said cover having one side integrally connected to the main body through a reduced-thickness portion which defines a hinge portion, the remaining portion except said hinge portion of said cover being integrally connected to the main body through a reduced-thickness separable portion;

a first engaging element in the form of a straight wall of an elastic material, projecting upright from and integrally with an outer surface of the main body outside of and adjacent to said hinge portion in parallel relation thereto; and a second engaging element in the form of a straight wall of the same elastic material as said first engaging element, and projecting upright and integrally with an outer surface of said cover at a position inside of said hinge portion in parallel relation thereto, said first engaging element having a hook-shaped distal end extending away from the second engaging element, the second engaging element having a hook-shaped distal end extending toward the first engaging element, the hook-shaped distal end of said second engaging element engaging the hook-shaped distal end of the first engaging element when said cover is swung in an opening direction about said hinge portion after the reduced-thickness separable portion is severed, to maintain the cover in an opened state.

2. A sealed gable top carton as set forth in claim 1, wherein a pipe- or case-like wall is formed integral with a rear surface of said cover and a lower end of said cover is connected to the main body through the reduced-thickness separable portion.

3. A sealed gable top carton as set forth in claim 2, wherein the height of said pipe- or case-like wall is gradually increased from the position corresponding to the hinge portion to the side opposite the hinge.

4. A sealed gable top carton as set forth in claim 2, wherein the pipe- or case-like wall has a size permitting the insertion thereof into the main body.

5. A sealed gable top carton as set forth in claim 4, wherein the outer surface of the pipe- or case-like wall has an engaging projection.

6. A sealed gable top carton as set forth in claim 1, wherein the cover is directly joined to the main body.

7. A sealed gable top carton as set forth in claim 1, wherein a tab is projected from the side of the cover opposite to the hinge portion.

8. A sealed gable top carton as set forth in claim 1, wherein the main body is in the form of a pipe or case.

9. A sealed gable top carton as set forth in claim 8, wherein the base end of the main body in the form of a pipe or a case is provided with a peripheral flange.

* * * * *